US011225935B1

(12) United States Patent
Dudar et al.

(10) Patent No.: US 11,225,935 B1
(45) Date of Patent: Jan. 18, 2022

(54) DUAL PATH PURGE SYSTEM FOR A TURBOCHARGED ENGINE

(71) Applicant: FORD GLOBAL TECHNOLOGIES, LLC, Dearborn, MI (US)

(72) Inventors: Aed M Dudar, Canton, MI (US); Scott Alan Bohr, Novi, MI (US); Roger Joseph Khami, Troy, MI (US); David S. Moyer, Sterling Heights, MI (US); Christopher Alan Myers, Holly, MI (US); Eric A. Macke, Ann Arbor, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 17/162,746

(22) Filed: Jan. 29, 2021

(51) Int. Cl.
*F02M 25/08* (2006.01)
*F02D 41/22* (2006.01)
*F02D 41/00* (2006.01)

(52) U.S. Cl.
CPC ..... *F02M 25/0836* (2013.01); *F02M 25/089* (2013.01); *F02D 41/0007* (2013.01); *F02D 41/0032* (2013.01); *F02D 2041/225* (2013.01); *F02D 2200/0406* (2013.01); *F02D 2250/41* (2013.01); *F02M 25/0809* (2013.01)

(58) Field of Classification Search
CPC ..... F02M 25/0836; F02M 25/089; F02M 25/0809; F02D 41/0032; F02D 2200/0406; F02D 2250/41; F02D 41/0007; F02D 2041/225
See application file for complete search history.

(56) References Cited

U.S. PATENT DOCUMENTS

| | | | | |
|---|---|---|---|---|
| 5,005,550 | A * | 4/1991 | Bugin, Jr. | F02M 25/089 123/520 |
| 6,152,115 | A | 11/2000 | Busato | |
| 9,885,323 | B1 | 2/2018 | Myers et al. | |
| 10,060,394 | B2 * | 8/2018 | Guidi | F02M 25/0836 |
| 10,107,233 | B2 | 10/2018 | Dudar et al. | |
| 2015/0292421 | A1 * | 10/2015 | Pursifull | F02D 41/004 123/518 |
| 2016/0201613 | A1 * | 7/2016 | Ulrey | F02D 41/0032 123/520 |
| 2017/0314512 | A1 * | 11/2017 | Dudar | F02D 41/0032 |
| 2018/0030932 | A1 * | 2/2018 | Dudar | F02M 25/0836 |
| 2018/0112634 | A1 * | 4/2018 | Hoffman | F02M 35/10229 |
| 2020/0141362 | A1 * | 5/2020 | Eom | F02D 41/004 |

* cited by examiner

*Primary Examiner* — Xiao En Mo
(74) *Attorney, Agent, or Firm* — Geoffrey Brumbaugh; Brooks Kushman P.C.

(57) ABSTRACT

A dual path fuel vapor purge system is disclosed for an engine having a turbocharger or a super. The purge system includes a canister configured to collect fuel vapor from a fuel tank. A canister purge valve is provided downstream from the canister. An ejector valve receives fuel vapors from the canister through the canister purge valve. A first vapor purge path directs the fuel vapor to an intake manifold of the engine. A second vapor purge path directs fuel vapor to an air induction system. A check valve downstream from the ejector valve receives the fuel vapor from the ejector and supplies the fuel vapor to the air induction system. Boost flow opens the check valve when the air induction system is in operation to boost the engine and closes the check valve when the engine is in operation with normal aspiration or when a leak is detected.

18 Claims, 2 Drawing Sheets

DUAL PATH PURGE SYSTEM FOR A TURBOCHARGED ENGINE

TECHNICAL FIELD

This disclosure is directed to a fuel vapor recovery system for an engine that may be operated in a normal aspiration mode or a boosted aspiration mode.

BACKGROUND

Vehicles may be required to adsorb refueling, diurnal, and running loss vapors into an activated carbon canister. Strict fuel evaporation emission standards must be met for vehicles to be certified in some markets. Once canister is loaded with fuel vapors, manifold vacuum may be used to clean out the canister in a process known as "purging" while the engine is running.

When a canister purge valve (CPV) is open, fresh air enters the canister from a fresh air line inlet. Fresh air displaces the fuel vapors inside the canister, and fuel vapors are sucked into the intake manifold to be combusted inside the engine. The fuel vapors in a normal aspiration mode flow through the CPV to an ejector and into the intake manifold. The fuel vapors in a boost mode (turbocharged, supercharged, and the like) flow through the CPV to the ejector and into a conduit downstream of the air inlet and air filter for the boost system and upstream from the boost system that directs the air and fuel vapors to the throttle and intake manifold of the engine.

In one prior art system, the ejector was assembled directly to the air injection system (AIS) housing. The cost of incorporating the ejector system into the AIS is considerable. In this system, if there is a leak to atmosphere from the fuel vapor recovery system, or an in-line check valve in the conduit from the ejector to the AIS breaks, the check valve will not seal. If the in-line check valve in the line from the ejector to the AIS breaks, unfiltered and unmetered air can enter the AIS and can disrupt air/fuel ratio provided to the engine and require adjustment by the engine controller. If the check valve breaks, fuel vapors may be leaked to the atmosphere.

This disclosure is directed to solving the above problems and other problems as summarized below.

SUMMARY

According to one aspect of this disclosure, a fuel vapor control system is disclosed for purging a fuel vapor canister in a vehicle that may be operated in a normal aspiration mode and in a boosted aspiration mode. The fuel vapor control system comprises a fuel tank and the fuel vapor canister for collecting fuel vapor from the fuel tank. A canister purge valve is configured to receive fuel vapors from the canister. An ejector valve controlled by the controller selectively provides the fuel vapors from the canister in a normal aspiration mode through a bypass valve in the ejector to an intake manifold. The ejector may selectively provide fuel vapors from the canister in a boost mode to an air induction system. The air induction system receives air from an air inlet through an air filter and supplies air to a conduit connected to a turbocharger. The turbocharger supplies the air to a throttle controlling air flow to the intake manifold. (as used herein the term "turbocharger" should be interpreted to include super charger systems) A check valve assembled to the air induction system receives fuel vapor from the ejector and adds the fuel vapors to the inlet air drawn by the air induction system.

According to another aspect of this disclosure, a dual path fuel vapor purge system is disclosed for an engine having a turbocharger or a super charger (as used herein the term "turbocharger" should be interpreted to include super charger systems). The purge system includes a canister configured to collect fuel vapor from a fuel tank. A canister purge valve is provided downstream from the canister. An ejector valve receives fuel vapors from the canister through the canister purge valve. A first vapor purge path directs the fuel vapor to an intake manifold of the engine. A second vapor purge path directs fuel vapor to an air induction system. A check valve downstream from the ejector valve receives the fuel vapor from the ejector valve and supplies the fuel vapor to the air induction system. Boost flow opens the check valve when the air induction system is in operation to boost the engine and closes the check valve when the engine is in operation with normal aspiration.

According to other aspects of the above fuel vapor control systems, a diagnostic algorithm monitors the vacuum level downstream from the ejector valve and upstream from the check valve to detect leakage from the conduit. The check valve is assembled to the air induction system (AIS) to be partially disposed in a conduit upstream from the turbocharger, and is partially disposed outside the AIS. A vacuum sensor adapted to measure the vacuum in the fuel vapor control system is monitored by the diagnostic algorithm. A bypass valve in an ejector downstream from the canister purge valve receives fuel vapor from the canister purge valve when the vehicle is operated in the normal aspiration mode with recirculation of air and fuel vapors in the AIS in the boost mode closing the check valve to direct the fuel vapors the intake manifold.

According to another aspect of this disclosure, a fuel vapor purge apparatus is disclosed that includes an air induction system and a check valve. The air induction system includes a housing defining a plenum that is adapted to enclose an air flow boost apparatus, the housing defines an opening upstream from the air flow boost apparatus. The check valve includes a base cup portion, a diaphragm, and a diaphragm guide that are integrally attached to the opening, wherein the check valve includes an inlet portion that directs fuel vapor to the diaphragm, and wherein the diaphragm maintains a seal with the base cup portion in the event that fuel vapor leaks from the system from the inlet portion or from the system upstream from the inlet portion.

According to another aspect of the fuel vapor purging article, the fuel vapor purging article may further comprise a canister enclosing an adsorbent for collecting fuel vapor from a vehicle fuel system, a canister purge valve for purging fuel vapor received from the canister, and an ejector that receives fuel vapor from the canister purge valve. The fuel vapor is directed and that directs the fuel vapor in a normal aspiration mode to an intake manifold of an engine. The ejector directs fuel vapor to the check valve in an air induction mode.

According to another aspect of the fuel vapor purging article, the base cup portion, and the diaphragm guide are joined to the housing by permanent connections including ultrasonic welds, thermal welds, or adhesive bonds.

According to other aspects of the fuel vapor purging article, the diaphragm is movably retained between the base cup portion and the diaphragm guide to move between a closed position and an open position. In the closed position fuel vapor is prevented from being directed into the air induction system. In the open position fuel vapor is directed into the air induction system. The diaphragm is held in the closed position by lower pressure (vacuum) inside the air induction system operating in a boost mode compared to higher pressure in the inlet portion when leaking of fuel vapor occurs upstream from the check valve. Leaking of fuel vapor upstream from the check valve is detectable by a diagnostic algorithm based on vacuum levels upstream from the diaphragm.

The above aspects of this disclosure and other aspects will be described below with reference to the attached drawings.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale, and some features may be exaggerated or minimized to show details of particular components. The specific structural and functional details disclosed are not to be interpreted as limiting, but as a representative basis for teaching one skilled in the art how to practice the disclosed concepts.

Figure 1:
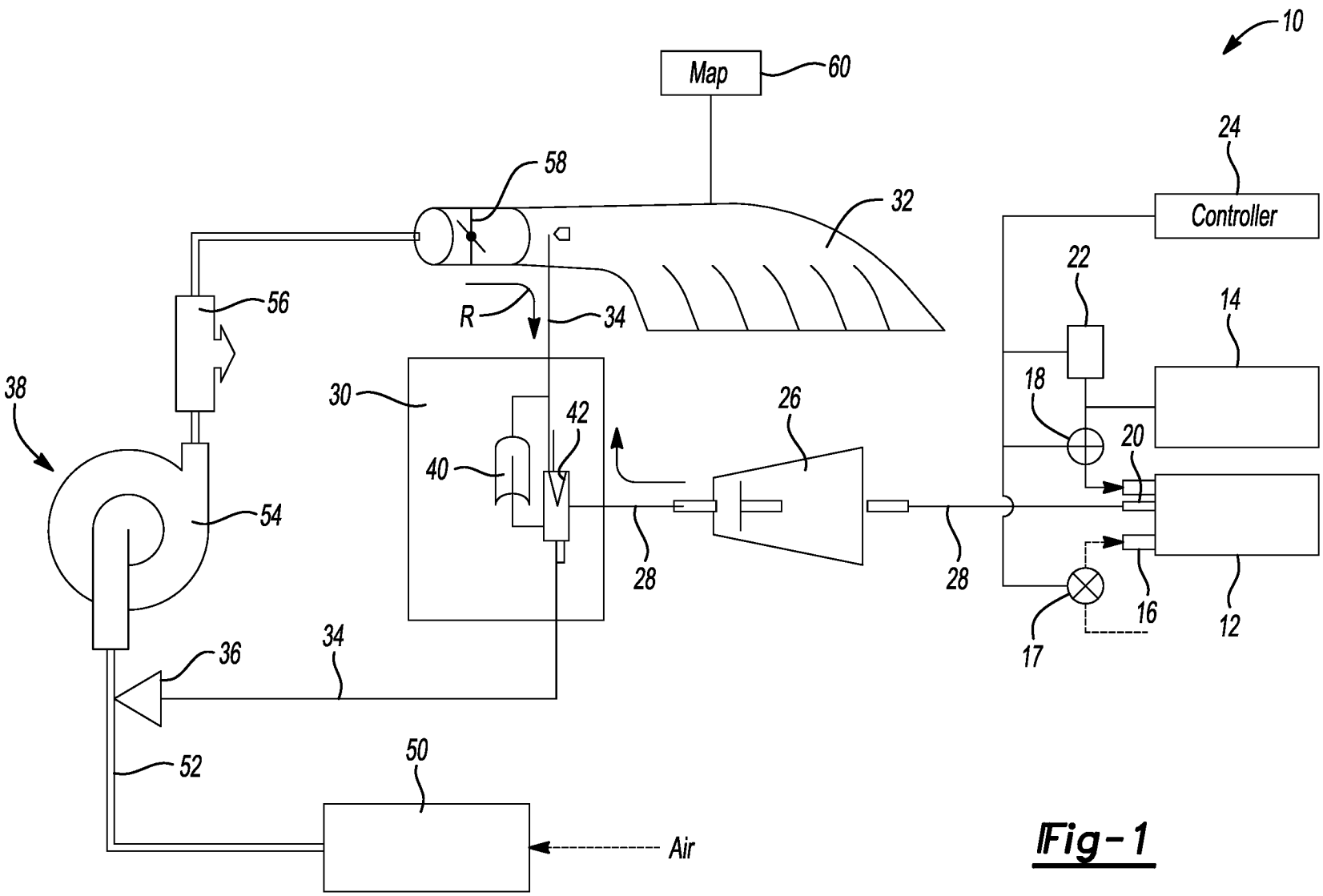
FIG. 1 is a diagrammatic flow chart of the dual path fuel vapor purge system for a vehicle that is operable in a normal aspiration mode or a boosted air induction mode.

Referring to FIG. 1, a fuel vapor purge system is generally indicated by reference numeral 10. The fuel vapor purge system 10 includes diagnostics for an inline bypass ejector. The system prevents vapors from being purged to atmosphere if check valve port breaks off the air induction system (AIS) or otherwise leaks. If a check valve inlet portion breaks off the AIS or is otherwise broken, fuel vapors may leak to atmosphere and a diagnostic algorithm will detect the reduction in vacuum in the system and set an error code.

The fuel vapor purge system 10 includes a fuel vapor canister (canister) 12 that collects fuel vapors from the fuel tank 14 during filling and from the refueling nozzle at the filler neck housing (not shown). The canister 12 includes a fresh air port 16, a canister vent valve (CVV) 17, a vent bypass valve (VBV) 18, and a purge port 20. A fuel tank pressure transducer 22 may be used to monitor the pressure in the canister 12 that is provided to a controller 24 to determine when the fuel vapor inside the canister 12 should be purged. The canister 12 is filled with an adsorbent such as activated charcoal that can adsorb the fuel vapors from the fuel tank 14, diurnal losses, and running losses. The fuel vapor is adsorbed by the adsorbent and the fuel vapors are desorbed when the canister 12 is purged.

The purge port 20 is connected to a canister purge valve (CPV) 26 in a conduit 28 that also extends through the CPV 26 to an ejector 30. Fuel vapor passes from the canister 12 through the CPV 26 and into the ejector 30. In the normal aspiration mode the bypass valve 40 in the ejector 30 directs fuel vapor from the ejector 30 through a conduit 31 to the intake manifold 32 of the engine. In the boost mode, fuel vapor passes through the CPV 26 and into the ejector 30. The ejector 30 then directs the fuel vapor from the ejector 30 through a conduit 34 to a check valve 36 that is assembled to the air induction system (AIS) 38 with the base cup 44, diaphragm 46, and diaphragm guide 48 inside the AIS and the inlet port (shown in FIGS. 2 and 3) of the check valve 36 being disposed outside the AIS 38 in FIG. 2 and shown being disposed partially inside the AIS in FIG. 3.

The ejector 30 includes a bypass valve 40 and a venturi device, such as a nozzle 42. The bypass valve 40 in normal aspiration mode directs fuel vapor into the intake manifold 32 of the engine as a result of vacuum in the intake manifold 32. In a boosted aspiration mode, the nozzle 42 receives recirculated gas flow shown by arrow "R" from the intake manifold 32. The nozzle 42 creates a venturi effect creating a vacuum that draws fuel vapor from the canister 12 through the canister purge valve 26 and directs the fuel vapors to the check valve 36. Gas flow from the intake manifold 32 to the ejector 30 in the boosted aspiration mode closes the bypass valve 40 and is recirculated through the AIS 38.

Figure 2:
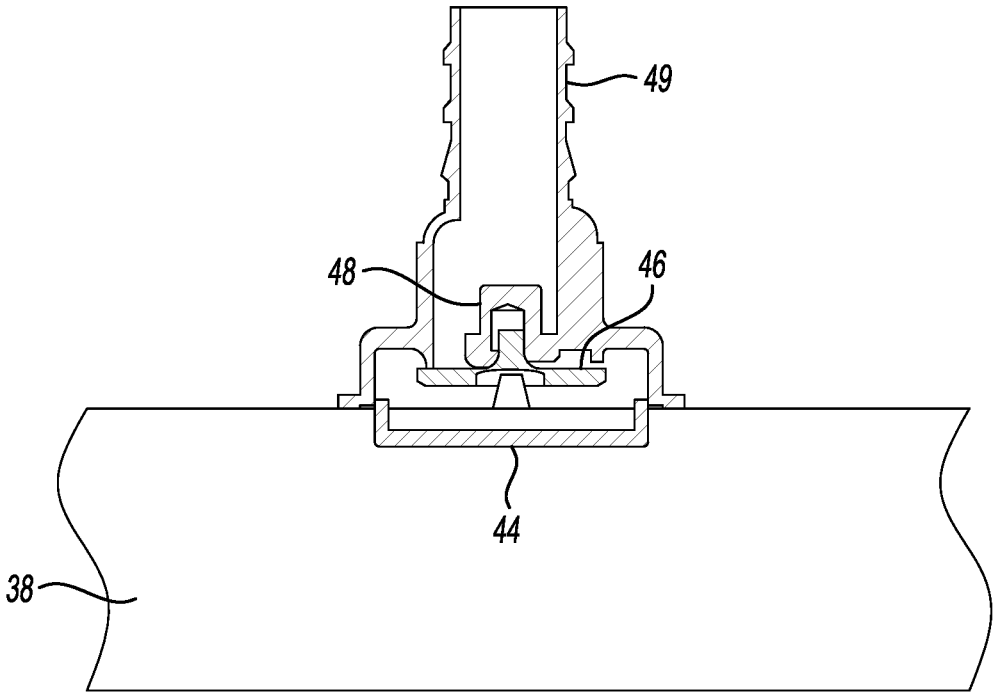
FIG. 2 is a diagrammatic view of a check valve integrated into the air induction system (AIS) with the valve cup, diaphragm, diaphragm guide inside the AIS and an inlet port attached to a wall outside the AIS.
Figure 3:
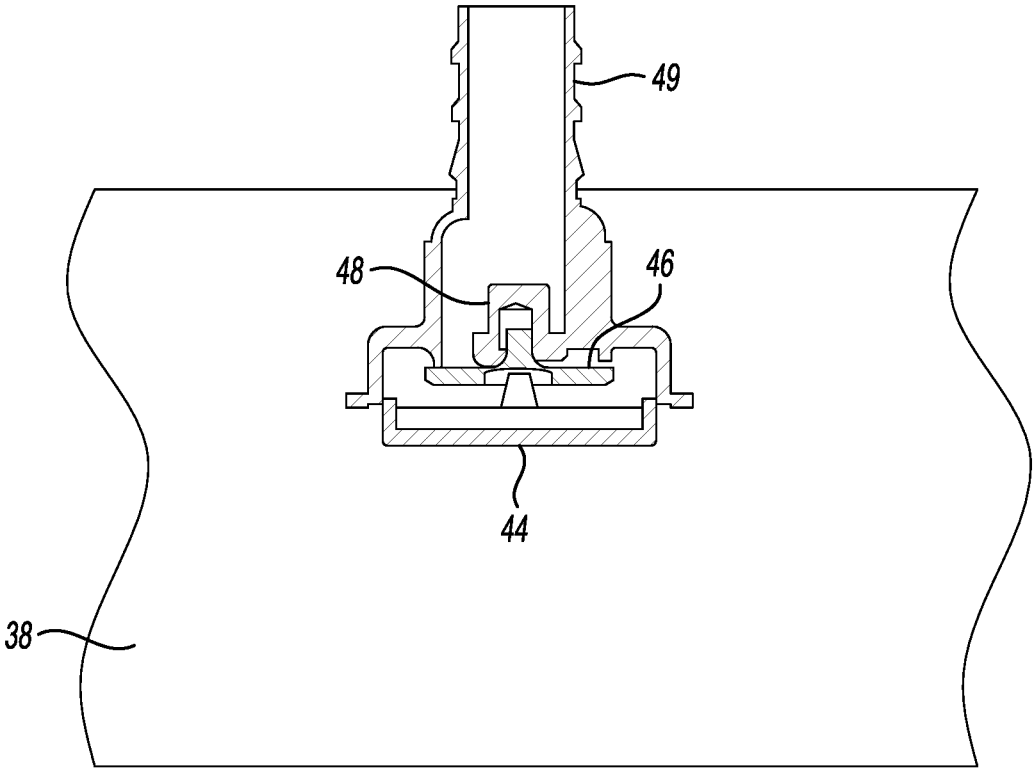
FIG. 3 is a diagrammatic view of a check valve integrated into the air induction system (AIS) with the valve cup, diaphragm, diaphragm guide inside the AIS and the inlet port being attached to the wall of the AIS with part of the inlet being disposed inside the AIS.

Referring to FIGS. 2 and 3, the check valve 36 is mounted onto the AIS 38 to prevent inhalation of unfiltered and unmetered air into the intake manifold 32 under natural aspiration. The check valve 36 includes a cup-shaped base 44, a diaphragm 46, and a diaphragm guide 48 that are integrated into the air induction system housing or a conduit upstream from the boost device that together form a plenum upstream from the turbocharger. The base 44 and diaphragm guide 46 of the check valve 36 are integrated into the AIS 38. Referring to FIG. 2, an inlet portion 49 of the check valve 36 is disposed outside the AIS 38 so that in the event the inlet portion 49 is broken or dislodged, leakage can be detected by the algorithm, and the base 44, and the check valve diaphragm 48 will remain sealed. In FIG. 3, an alternative embodiment is shown wherein the inlet portion 49 is partially disposed inside the AIS and partially disposed outside the AIS. The inlet portion may be connected by a weld or other connection to the AIS that is frangible to break off the AIS while the other parts of the check valve 36 remain intact in the AIS.

Referring again to FIG. 1, the AIS 38 receives ambient air through an air filter 50 that prevents foreign particulates from being provided to the engine. The AIS 38 includes a conduit 52 that directs air from the air inlet filter 50 to a turbocharger 54, then to a charge air cooler 56, and to the throttle 58. The throttle 58 controls the flow of air and fuel vapors to the intake manifold 32 of the engine. The check valve 34 is assembled to the AIS 38 downstream from the air filter 50 and upstream from the turbocharger 54.

A canister vent valve (CVV) 17 is opened to allow fresh air to displace the fuel vapor inside the canister 12. The CPV 26 when opened draws fresh air through the CVV 17 into the canister 12 via the fresh air port 16. The fuel vapor is sucked into the intake manifold 32 in the normally aspirated mode to be combusted by the engine. The intake manifold 32 is part of the engine that is not otherwise illustrated in the drawing and is the location where a manifold air pressure sensor 60 is located.

When the AIS 38 is active, fuel vapors are directed to the AIS 38 through the conduit 34 to the check valve 36 that direct fuel vapor into the AIS 38. A vacuum sensor, for example the fuel tank pressure sensor 22, monitors the vacuum level in the AIS 38 to detect leaks in the check valve 36 or other part of the fuel vapor purge system 10. Vacuum level can be monitored by a vacuum sensor such as the fuel tank pressure sensor 22, a manifold air pressure (MAP)

sensor 60, or another vacuum sensor inside the fuel vapor purge system 10 that senses the level of vacuum in the fuel vapor purge system 10. The vacuum sensor 22 detects whether there is a leak in the fuel vapor purge system 10 (a sealed system) that causes a reduction of vacuum in the system 10.

The diagnostic algorithm can detect whether the check valve 36 has an issue in an open state, if the inlet portion of the check valve is broken, or if there is another leak in the fuel vapor purge system 10. In the event of a leak to atmosphere, the system 10 will take longer to pull down to a predetermined vacuum level corresponding to a no leak condition and a controller 24 will set a diagnostic error flag for service.

The diagnostic algorithm is stored in the controller 24 as executable instructions executed by the controller 24 based on instructions stored in memory and signals from the vacuum sensor 22. The controller 24 receives the vacuum level signal from the vacuum sensor 22 and measures the time required by the system 10 to return to a predetermined level of vacuum. The controller 24 uses fuel system actuators and fuel vapor purge system 10 actuators such as the canister purge valve (CPV) and the canister vent valve (CVV) to control the canister purge process. The controller may also control the turbocharger and throttle operation.

The diagnostic algorithm can detect a stuck open check valve 36 in the boosted mode when there is a leak to atmosphere. The diagnostic algorithm monitors the vacuum sensor 22. If the check valve 36 sticks closed, vacuum is not generated inside the ejector 30 which is a condition that is also detectable by the diagnostic algorithm.

If the check valve 36 inlet port 49 breaks, fuel vapor will leak to atmosphere and is detectable by the diagnostic algorithm. If the inlet port 49 breaks, the seal provided by the check valve is maintained, and unfiltered and unmetered air does not enter the engine and interfere with operation of the engine. A slight vacuum in the conduit 52 or AIS 38 between air filter 50 and turbocharger 54 during engine operation ensures that the diaphragm 46 in the check valve 36 remains sealed.

The embodiments described above are specific examples that do not describe all possible forms of the disclosure. The features of the illustrated embodiments may be combined to form further embodiments of the disclosed concepts. The words used in the specification are words of description rather than limitation. The scope of the following claims is broader than the specifically disclosed embodiments and also includes modifications of the illustrated embodiments.

What is claimed is:

1. A fuel vapor control system comprising:

a fuel tank;

a controller;

a canister is adapted to receive fuel vapors from the fuel tank;

a canister purge valve is configured to receive fuel vapors from the canister;

an ejector controlled by the controller selectively provides the fuel vapors from the canister in a normal aspiration mode to an intake manifold, wherein the ejector selectively provides fuel vapors from the canister in a boost mode to an air induction system that receives air from an air inlet and supplies air to a turbocharger, and wherein the turbocharger supplies the air to a throttle controlling air flow to the intake manifold; and a check valve integrated into the air induction system receives fuel vapor from the ejector and supplies the fuel vapors to the air induction system.

2. The fuel vapor control system of claim 1 wherein the check valve includes a cup-shaped base, a diaphragm, and a diaphragm guide integrated into the air induction system upstream from the turbocharger, an inlet portion of the check valve is disposed outside the air induction system, when the inlet portion is broken or dislodged, a leak can be detected, while the base, and the check valve diaphragm remain sealed.

3. The fuel vapor control system of claim 1 further comprising:

a diagnostic algorithm monitors a vacuum sensor that detects a vacuum level in the fuel vapor control system and detects vacuum leakage from the air induction system.

4. The fuel vapor control system of claim 3 wherein the vacuum sensor may be selected from the group consisting of:

a fuel tank pressure transducer; and a manifold air pressure sensor.

5. The fuel vapor control system of claim 1 further comprises:

a bypass valve in the ejector downstream from the canister purge valve receives fuel vapor from the canister purge valve, wherein when the fuel vapor control system is operated in the normal aspiration mode, the fuel vapors are directed by the bypass valve to the intake manifold.

6. The fuel vapor control system of claim 1 wherein a bypass valve is closed by recirculated air and fuel vapors when operated in the boost mode to direct the air and fuel vapor to the air induction system.

7. A fuel vapor purge system for an engine having a turbocharger, comprising:

a canister adapted to collect fuel vapor from a fuel tank;

a canister purge valve downstream from the canister;

an ejector receives fuel vapors from the canister through the canister purge valve;

a first vapor purge path directs the fuel vapor to an intake manifold of the engine;

a second vapor purge path directs fuel vapor to an air induction system; and a check valve downstream from the ejector receives fuel vapor from the ejector and supplies the fuel vapor to the air induction system, wherein the check valve is integrated into the air induction system with an inlet portion of the check valve disposed at least partially outside the air induction system housing, wherein the check valve is open when the air induction system is in a boost mode, the check valve is closed when the engine is in a normal aspiration mode, and the check valve is closed when a loss of vacuum occurs in the fuel vapor purge system.

8. The fuel vapor purge system of claim 7 wherein the check valve includes a cup, a diaphragm, and a diaphragm guide that are integrated into the air induction system housing or a conduit upstream from the turbocharger, and an inlet portion of the check valve is disposed outside the conduit, wherein when the inlet portion is broken or dislodged, a leak can be detected, and the cup, a diaphragm of the check valve, and a diaphragm guide will remain sealed.

9. The fuel vapor purge system of claim 7 further comprising:

a diagnostic algorithm monitors a vacuum sensor that detects leakage from the fuel vapor purge system.

10. The fuel vapor purge system of claim 9 wherein the vacuum sensor may be selected from the group consisting of:

a fuel tank pressure transducer; and a manifold air pressure sensor.

11. The fuel vapor purge system of claim 7 further comprises:

a bypass valve in the ejector downstream from the canister purge valve receives fuel vapor from the canister purge valve, wherein when the fuel vapor purge system is operated in the normal aspiration mode, the fuel vapors are directed by the bypass valve to the intake manifold.

12. The fuel vapor purge system of claim 11 wherein the bypass valve is closed by recirculated air and fuel vapors when operated in the boost mode to direct the air and fuel vapor to the air induction system.

13. A fuel vapor purging apparatus, comprising:

an air induction system having a housing defining an opening, wherein the housing is adapted to enclose an air flow boost apparatus downstream from the opening; and a check valve including a base cup portion, a diaphragm, and a diaphragm guide that are integrally attached to the opening, wherein the check valve includes an inlet portion that directs fuel vapor to the diaphragm, and wherein the diaphragm maintains a seal with the base cup portion when the inlet portion leaks fuel vapor.

14. The fuel vapor purging article of claim 13 further comprising:

a canister enclosing an adsorbent for collecting fuel vapor from a vehicle fuel system;

a canister purge valve for purging fuel vapor received from the canister; and an ejector receiving fuel vapor from the canister purge valve that directs the fuel vapor in a normal aspiration mode to an intake manifold of an engine, wherein the ejector directs fuel vapor to the check valve in an air induction mode.

15. The fuel vapor purging apparatus of claim 13 wherein the base cup portion, and the diaphragm guide are joined to the housing by permanent connections selected from a group consisting essentially of:

ultrasonic welds;

thermal welds; and adhesive bonds.

16. The fuel vapor purging apparatus of claim 15 wherein the diaphragm is movably retained between the base cup portion and the diaphragm guide to move between a closed position and an open position, wherein in a closed position fuel vapor is prevented from being directed into the air induction system, and wherein in an open position fuel vapor is directed into the air induction system.

17. The fuel vapor purging apparatus of claim 16 wherein the diaphragm is held in the closed position by lower pressure inside the air induction system operating in a boost mode compared to higher pressure in the inlet portion of the check valve when leaking of fuel vapor occurs upstream from the check valve.

18. The fuel vapor purging apparatus of claim 17 wherein leaking of fuel vapor upstream from the check valve is detected by a diagnostic algorithm based on vacuum levels upstream from the check valve.

* * * * *